US007407562B2

(12) United States Patent
Heikkinen et al.

(10) Patent No.: US 7,407,562 B2
(45) **Date of Patent: *Aug. 5, 2008**

(54) METHOD, SYSTEM AND CALENDAR FOR CONTROLLING THE MOISTURE PROFILE AND/OR MOISTURE GRADIENT OF A PAPER WEB, AND A WEB

(75) Inventors: Antti Heikkinen, Helsinki (FI); Harri Kuosa, Järvenpää (FI); Pekka Linnonmaa, Järvenpää (FI); Hannu Lätti, Järvenpää (FI); Markku Kyytsönen, Numminen (FI); Markko Jaakkola, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 500 days.

This patent is subject to a terminal disclaimer.

(21) Appl. No.: 10/518,416

(22) PCT Filed: Jun. 16, 2003

(86) PCT No.: PCT/FI03/00482

§ 371 (c)(1),
(2), (4) Date: Dec. 17, 2004

(87) PCT Pub. No.: WO04/001126

PCT Pub. Date: Dec. 31, 2003

(65) Prior Publication Data

US 2006/0118259 A1 Jun. 8, 2006

(30) Foreign Application Priority Data

Jun. 19, 2002 (FI) ..... 20021200

(51) Int. Cl.
*D21F 11/00* (2006.01)

(52) U.S. Cl. ..... 162/198; 162/263; 162/205; 162/206; 162/207; 100/38; 100/40; 100/74; 100/75

(58) Field of Classification Search ..... 162/198, 162/205, 206, 207, 263; 100/38, 40
See application file for complete search history.

(56) References Cited

U.S. PATENT DOCUMENTS 4,642,164 A 2/1987 Hanhikoski et al.

(Continued)

FOREIGN PATENT DOCUMENTS

CA 2110786 9/1997

(Continued)

OTHER PUBLICATIONS

Search Report issued in FI 20021200.

(Continued)

*Primary Examiner*—Mark Halpern
(74) *Attorney, Agent, or Firm*—Stiennon & Stiennon

(57) ABSTRACT

The moisture profile and/or moisture gradient of a paper web of at least SC quality paper is controlled in a paper machine comprising a calender (1) which has at least two roll stacks (21, 22; 31, 32), one stack has at least three rolls and another has at least five rolls. The web is moisturized to a desired pre-moisture content M1 by a pre-moisturizer (7) before the calender. At least one intermediate moisturizer (3) is arranged between two roll stacks moisturizes the web to a desired intermediate moisture content M2 before the last roll stack (31, 32), in which the web is dried to a desired final moisture value M3. For continuously controlling and optimizing the moisture profile and/or moisture gradient of the web, the pre-moisturizing W1 of the web is controlled by a pre-moisturizer (7) control parameter which corresponds to the final moisture value M3 of the web.

7 Claims, 7 Drawing Sheets

U.S. PATENT DOCUMENTS

| | | | | |
|---|---|---|---|---|
| 5,065,673 | A * | 11/1991 | Taylor et al. | 100/40 |
| 5,163,365 | A | 11/1992 | Taylor | |
| 6,073,549 | A | 6/2000 | Winheim et al. | |
| 6,401,355 | B1 | 6/2002 | Linnonmaa et al. | |
| 6,500,305 | B1 | 12/2002 | Winheim et al. | |
| 6,698,342 | B1 | 3/2004 | Heikkinen et al. | |
| 6,758,135 | B2 | 7/2004 | Linnonmaa et al. | |
| 7,059,066 | B2 | 6/2006 | Maurer | |

FOREIGN PATENT DOCUMENTS

| | | | |
|---|---|---|---|
| DE | 3741680 | A1 | 6/1989 |
| EP | 0 979 897 | A2 | 2/2000 |
| EP | 0 979 897 | A3 | 5/2000 |
| EP | 1335066 | A1 | 8/2003 |
| FI | 100671 | B | 1/1998 |
| FI | 113072 | B | 2/2004 |
| WO | WO 00/70146 | A2 | 11/2000 |
| WO | WO 00/70146 | A3 | 11/2000 |
| WO | WO 01/23666 | A2 | 4/2001 |
| WO | WO 01/23666 | A3 | 4/2001 |
| WO | 01/55504 | A1 | 8/2001 |
| WO | WO 01/75224 | A1 | 10/2001 |
| WO | WO 04/001126 | A1 | 12/2003 |
| WO | 2005/088009 | A1 | 9/2005 |

OTHER PUBLICATIONS

International Search Report issued in PCT/FI03/00482.
International Preliminary Examination Report issued in PCT/FI03/00482.
"Papermarking Part 3, Finishing", Papermarking Science and Technology Book 10, Fapet Oy © 1999.
English Abstract of EP 1335066.

* cited by examiner

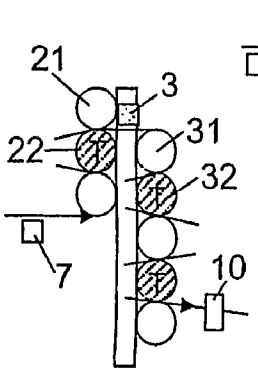
FIG.1A$_1$
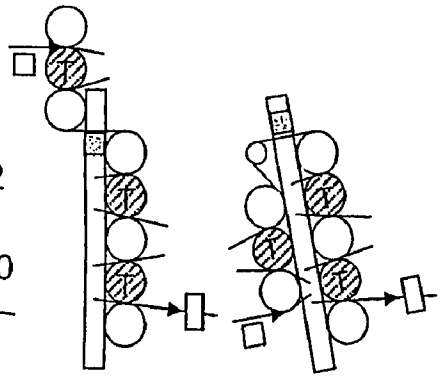
FIG.1A$_2$
FIG.1A$_3$
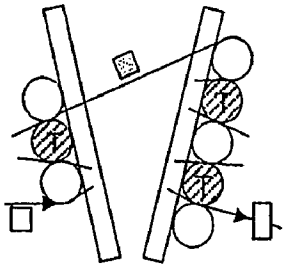
FIG.1A$_4$
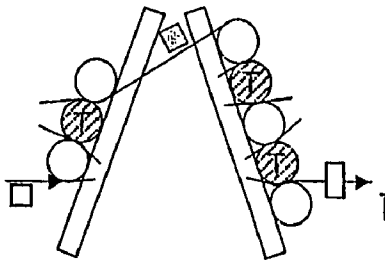
FIG.1A$_5$
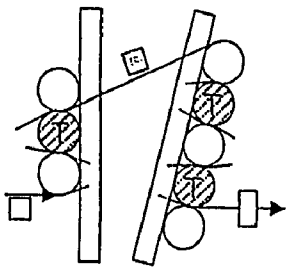
FIG.1A$_6$
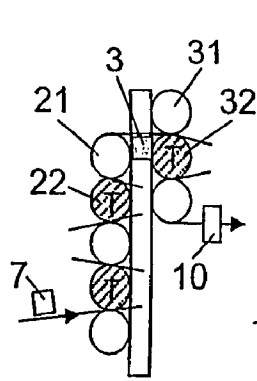
FIG.1B$_1$
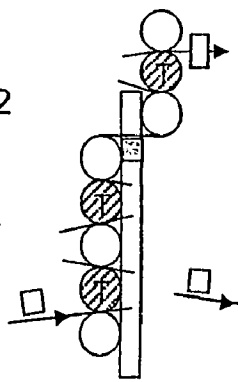
FIG.1B$_2$
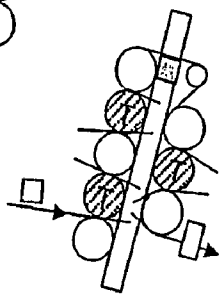
FIG.1B$_3$
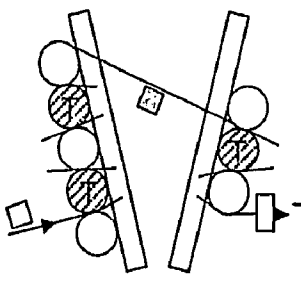
FIG.1B$_4$
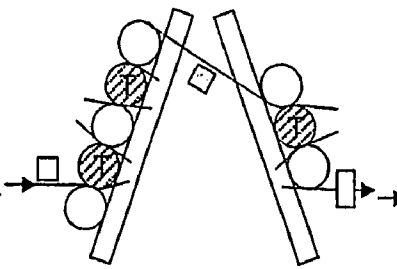
FIG.1B$_5$
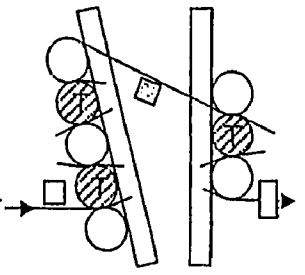
FIG.1B$_6$

| Paper grade | Grammage, g/m² | Speed, m/min | Stack | $M_0$, % | $W_1$,thermo g/m² | $W_1$,polymer g/m² | $W_{tot}$ g/m² | $M_1$, % | $E_1$, % | $M2_0$, % | $W_2$, g/m² | $M2_1$, % | $E_2$, % | $M_3$, % |
|---|---|---|---|---|---|---|---|---|---|---|---|---|---|---|
| SC-A | 52 | 1000 | 5+5 | 3 | 2,5 | 1,3 | 3,8 | 9,7 | 3,7 | 6 | 1,3 | 8,3 | 3,3 | 5 |
| | 52 | 1500 | 5+5 | 3 | 2,6 | 1,4 | 4,0 | 10,1 | 4,1 | 6 | 1,6 | 8,8 | 3,8 | 5 |
| | 52 | 2000 | 5+5 | 3 | 2,8 | 1,5 | 4,3 | 10,6 | 4,6 | 6 | 1,9 | 9,3 | 4,3 | 5 |
| | 60 | 1000 | 5+5 | 3 | 2,7 | 1,4 | 4,1 | 9,3 | 3,3 | 6 | 1,5 | 8,3 | 3,3 | 5 |
| | 60 | 1500 | 5+5 | 3 | 2,8 | 1,5 | 4,3 | 9,6 | 3,6 | 6 | 1,8 | 8,7 | 3,7 | 5 |
| | 60 | 2000 | 5+5 | 3 | 3,0 | 1,6 | 4,6 | 10,0 | 4,0 | 6 | 2,1 | 9,2 | 4,2 | 5 |
| | 52 | 1000 | 5+5 | 5 | 1,7 | 0,9 | 2,6 | 9,7 | 3,7 | 6 | 1,3 | 8,3 | 3,3 | 5 |
| | 52 | 1500 | 5+5 | 5 | 1,8 | 1,0 | 2,8 | 10,1 | 4,1 | 6 | 1,6 | 8,8 | 3,8 | 5 |
| | 52 | 2000 | 5+5 | 5 | 2,0 | 1,1 | 3,1 | 10,6 | 4,6 | 6 | 1,9 | 9,3 | 4,3 | 5 |
| | 60 | 1000 | 5+5 | 5 | 1,8 | 1,0 | 2,8 | 9,4 | 3,4 | 6 | 1,5 | 8,3 | 3,3 | 5 |
| | 60 | 1500 | 5+5 | 5 | 2,0 | 1,1 | 3,0 | 9,7 | 3,7 | 6 | 1,8 | 8,7 | 3,7 | 5 |
| | 60 | 2000 | 5+5 | 5 | 2,1 | 1,2 | 3,3 | 10,1 | 4,1 | 6 | 2,1 | 9,2 | 4,2 | 5 |
| | 52 | 1000 | 5+5 | 3 | 3,2 | 1,7 | 5,0 | 11,6 | 3,6 | 8 | 0,2 | 8,5 | 3,5 | 5 |
| | 52 | 1500 | 5+5 | 3 | 3,3 | 1,8 | 5,2 | 11,9 | 3,9 | 8 | 0,4 | 8,9 | 3,9 | 5 |
| | 52 | 2000 | 5+5 | 3 | 3,5 | 1,9 | 5,5 | 12,4 | 4,4 | 8 | 0,7 | 9,4 | 4,4 | 5 |
| | 60 | 1000 | 5+5 | 3 | 3,4 | 1,8 | 5,3 | 10,9 | 2,9 | 8 | 0,3 | 8,6 | 3,6 | 5 |
| | 60 | 1500 | 5+5 | 3 | 3,5 | 1,9 | 5,5 | 11,2 | 3,2 | 8 | 0,5 | 8,9 | 3,9 | 5 |
| | 60 | 2000 | 5+5 | 3 | 3,7 | 2,0 | 5,8 | 11,6 | 3,6 | 8 | 0,8 | 9,4 | 4,4 | 5 |
| | 52 | 1000 | 5+5 | 5 | 2,4 | 1,3 | 3,8 | 11,6 | 3,6 | 8 | 0,2 | 8,5 | 3,5 | 5 |
| | 52 | 1500 | 5+5 | 5 | 2,6 | 1,4 | 4,0 | 11,9 | 3,9 | 8 | 0,4 | 8,9 | 3,9 | 5 |
| | 52 | 2000 | 5+5 | 5 | 2,8 | 1,5 | 4,3 | 12,4 | 4,4 | 8 | 0,7 | 9,4 | 4,4 | 5 |
| | 60 | 1000 | 5+5 | 5 | 2,6 | 1,4 | 4,0 | 11,1 | 3,1 | 8 | 0,3 | 8,6 | 3,6 | 5 |
| | 60 | 1500 | 5+5 | 5 | 2,7 | 1,5 | 4,2 | 11,4 | 3,4 | 8 | 0,5 | 8,9 | 3,9 | 5 |
| | 60 | 2000 | 5+5 | 5 | 2,9 | 1,6 | 4,5 | 11,8 | 3,8 | 8 | 0,8 | 9,4 | 4,4 | 5 |
| SC-B | 60 | 1000 | 3+5 | 3 | 2,3 | 1,2 | 3,5 | 8,4 | 2,4 | 6 | 1,5 | 8,3 | 3,3 | 5 |
| | 60 | 2000 | 3+5 | 3 | 2,5 | 1,4 | 3,9 | 9,0 | 3,0 | 6 | 2,1 | 9,2 | 4,2 | 5 |
| | 60 | 1000 | 3+5 | 5 | 1,4 | 0,8 | 2,2 | 8,5 | 2,5 | 6 | 1,5 | 8,3 | 3,3 | 5 |
| | 60 | 2000 | 3+5 | 5 | 1,7 | 0,9 | 2,6 | 9,1 | 3,1 | 6 | 2,1 | 9,2 | 4,2 | 5 |
| | 60 | 1000 | 3+5 | 3 | 3,0 | 1,6 | 4,7 | 10,1 | 2,1 | 8 | 0,3 | 8,6 | 3,6 | 5 |
| | 60 | 2000 | 3+5 | 3 | 3,3 | 1,8 | 5,1 | 10,7 | 2,7 | 8 | 0,8 | 9,4 | 4,4 | 5 |
| | 60 | 1000 | 3+5 | 5 | 2,2 | 1,2 | 3,4 | 10,2 | 2,2 | 8 | 0,3 | 8,6 | 3,6 | 5 |
| | 60 | 2000 | 3+5 | 5 | 2,4 | 1,3 | 3,8 | 10,8 | 2,8 | 8 | 0,8 | 9,4 | 4,4 | 5 |
| SC-C | 60 | 1000 | 3+3 | 5 | 1,4 | 0,8 | 2,2 | 8,5 | 2,5 | 6 | 1,1 | 7,7 | 2,7 | 5 |
| | 60 | 2000 | 3+3 | 5 | 1,7 | 0,9 | 2,6 | 9,1 | 3,1 | 6 | 1,5 | 8,3 | 3,3 | 5 |
| | 60 | 1000 | 3+5 | 5 | 2,2 | 1,2 | 3,4 | 10,2 | 2,2 | 8 | 0,0 | 8,2 | 3,2 | 5 |
| | 60 | 2000 | 3+5 | 5 | 2,4 | 1,3 | 3,8 | 10,8 | 2,8 | 8 | 0,1 | 8,3 | 3,3 | 5 |

FIG. 6

METHOD, SYSTEM AND CALENDAR FOR CONTROLLING THE MOISTURE PROFILE AND/OR MOISTURE GRADIENT OF A PAPER WEB, AND A WEB

CROSS REFERENCES TO RELATED APPLICATIONS

This application is a U.S. national stage application of International App. No. PCT/FI2003/000482, filed Jun. 16, 2003, the disclosure of which is incorporated by reference herein, and claims priority on Finnish Application No. 20021200, Filed Jun. 19, 2002.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to the production of a fibrous web, such as a paper web, advantageously a high-quality SC paper web, by means of an on-line or off-line multi-nip calender.

In this description and definitions of the invention

- a web refers to a fibrous web, advantageously a paper web, most advantageously an SC paper web, which is formed of mechanical pulp and/or chemical pulp, advantageously having a basis weight in a range of 30 to 80 g/m$^2$ and a filler content in a range of 15 to 40 percent;
- a multi-nip calender refers to an on-line or off-line calender comprising at least two separate roll stacks, which are apart from one another in a vertical or horizontal direction with respect to the horizontal machine plane and placed in a vertical, horizontal and/or oblique position with respect to the machine plane, said roll stacks comprising each at least three rolls which form at least two nips in nip contacts loaded against each other; and
- a nip refers to a pressing zone of the web which two thermo rolls loaded against each other, i.e. a hard press roll and a soft-covered polymer roll, i.e. a backing roll, form between themselves, in which pressing zone the web is deformed as a result of moisture, heat and compression.

In the papermaking art, grades of ever higher quality are required today. As the running speeds required from paper machines are continuously increasing, the direction in calendering technology is more and more towards on-line solutions. When the aim is to make higher-quality printing paper grades, such as, for example, SC paper grades, a substantial problem is that the grade can be produced in practice only by using, after drying a multi-layer web, rewinding and off-line calendering, several of which, usually two or three, are used side by side to meet production capacity.

It is generally stated that calendering is a method by means of which the properties, in particular the thickness profile, smoothness, gloss and surface porosity of a web-like material are sought to be improved. In calendering the web is passed into a nip which is formed between rolls pressed against each other and in which the web is deformed by the action of temperature, moisture and nip pressure, whereby the physical properties of the web can be affected by controlling the above-mentioned parameters and the time of action. The good physical properties attained by calendering lead to better print quality, thereby bringing a competitive advantage to the manufacturer of paper. A problem in conventional calendering, in which the web is moisturized only before a calender, is the unnecessarily heavy penetration of moisture into the web. To diminish this problem, a calender with two roll stacks is known from FI patent application 992086, in which calender intermediate moisturizing of the web has been arranged between the roll stacks in an attempt to regulate the penetration of moisture into a fibrous web and thereby control the moisture gradient of the web.

SUMMARY OF THE INVENTION

An object of the present invention is to eliminate or at least substantially reduce the problems and shortcomings of the prior art as well as the drawbacks and process problems associated with forming and calendering in the manufacture of a high-quality paper web, a paper web of at least SC quality, and by optimizing the thickness direction, i.e. z-direction structure of the web by means of moisture and temperature gradient calendering, i.e. optimizing the distribution of material in the web, in particular in a multi-layer web, in which different layers may have, when needed, even different properties.

One particular object of the invention is to provide a novel method for controlling the moisture profile and/or moisture gradient of a web for the production of a high-quality and uncoated fibrous web, advantageously a paper web, most advantageously a paper web of at least SC quality.

A second particular object of the invention is to provide a novel system for controlling the moisture profile and/or moisture gradient of a web for the production of a high-quality and uncoated fibrous web, advantageously a paper web, most advantageously a paper web of at least SC quality.

A third particular object of the invention is to provide a novel calender for controlling the moisture profile and/or moisture gradient of a web for the production of a high-quality and uncoated fibrous web, advantageously a paper web, most advantageously a paper web of at least SC quality.

A fourth particular object of the invention is to enable a novel web composition and improved quality for an uncoated web, advantageously for a fibrous web, more advantageously for a paper web and most advantageously for an uncoated paper web.

With respect to the benefits of the invention, it may be mentioned that by means of the moisturizing and moisture gradient calendering in accordance with the invention and because of control of the moisture content of the web during calendering it is possible to better and more precisely affect only the web and in particular its surface layers, so that, for example, the inner layers of a multi-layer web can be left substantially untouched. In accordance with one embodiment of the invention, the invention is suitable for use in the production of multi-layer webs. The invention increases substantially the possibilities of producing higher-quality and different paper grades. Moreover, it is possible to achieve good layer purity and an even layer thickness. It may be further stated that the possibilities of regulating the structure of paper in the z-direction separately in each layer are improved, and it is also possible to regulate the amount and/or the type of the filler in a direction transverse to the process direction, or machine direction, to assure a uniform distribution of material both in the width and in the longitudinal direction of the web.

In the following, the invention will be described in greater detail by means of one of its embodiments considered to be advantageous with reference to the appended patent drawings.

FIG. $\mathbf{1}A_{1\text{-}6}$ and FIG. $\mathbf{1}B_{1\text{-}6}$ schematically show some possible embodiments of the roll stacks of a calender in accordance with the invention.

Figure 2:
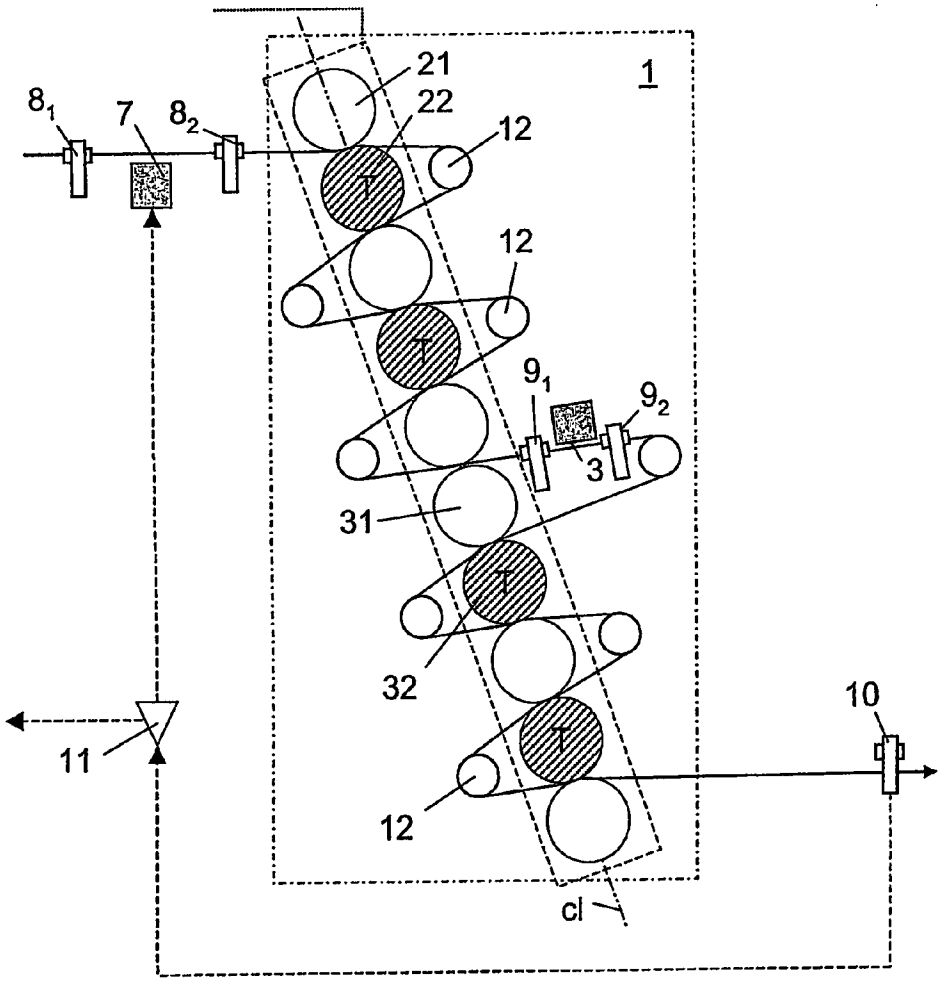

FIG. 2 is a schematic view of a second embodiment of the invention considered to be advantageous, showing an inclined calender with the upper and lower stacks each including five rolls for 2-sided calendering.

Figure 3:
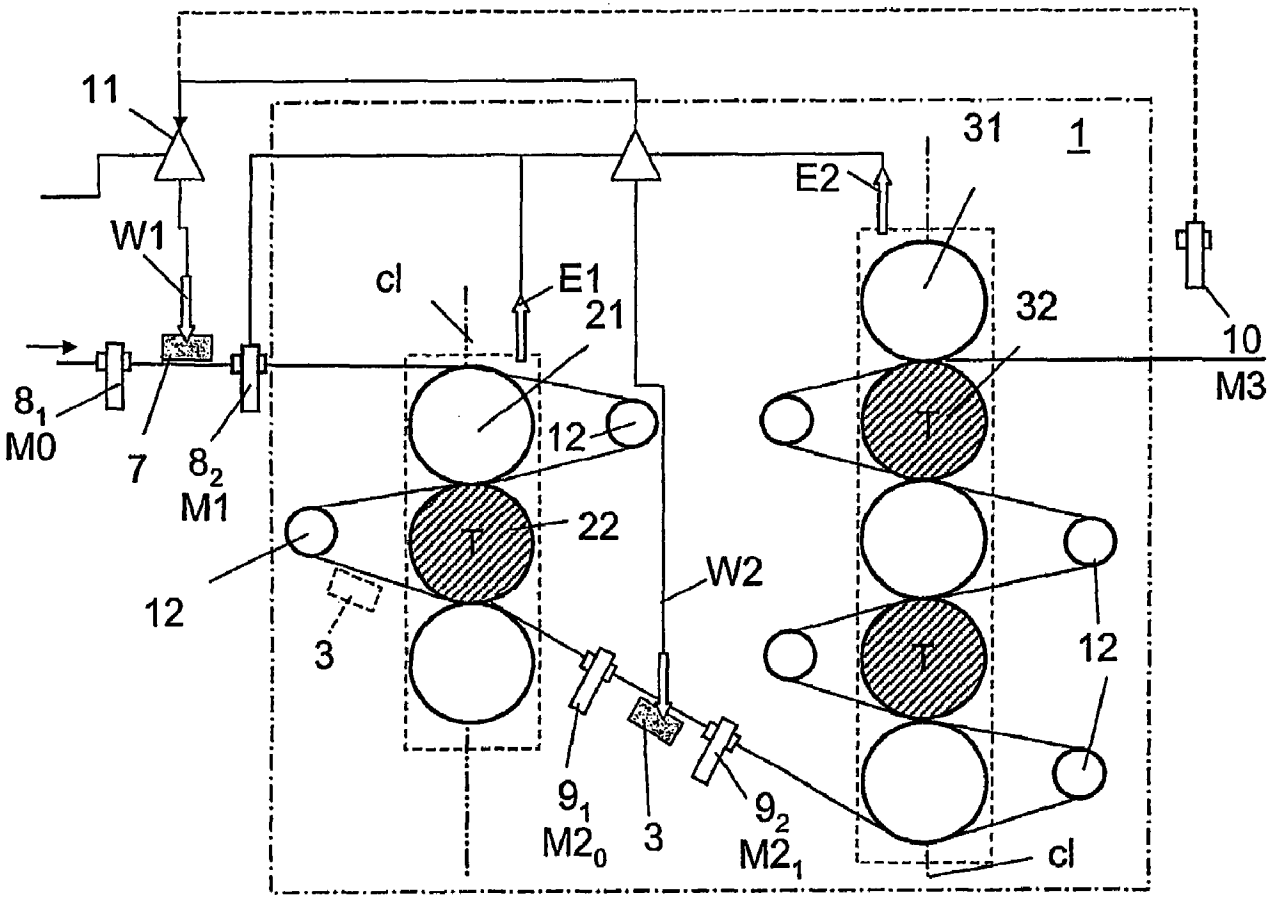

FIG. 3 is a schematic view of a third embodiment of the invention considered to be advantageous, showing 2-sided calendering by vertical stacks.

Figure 4:
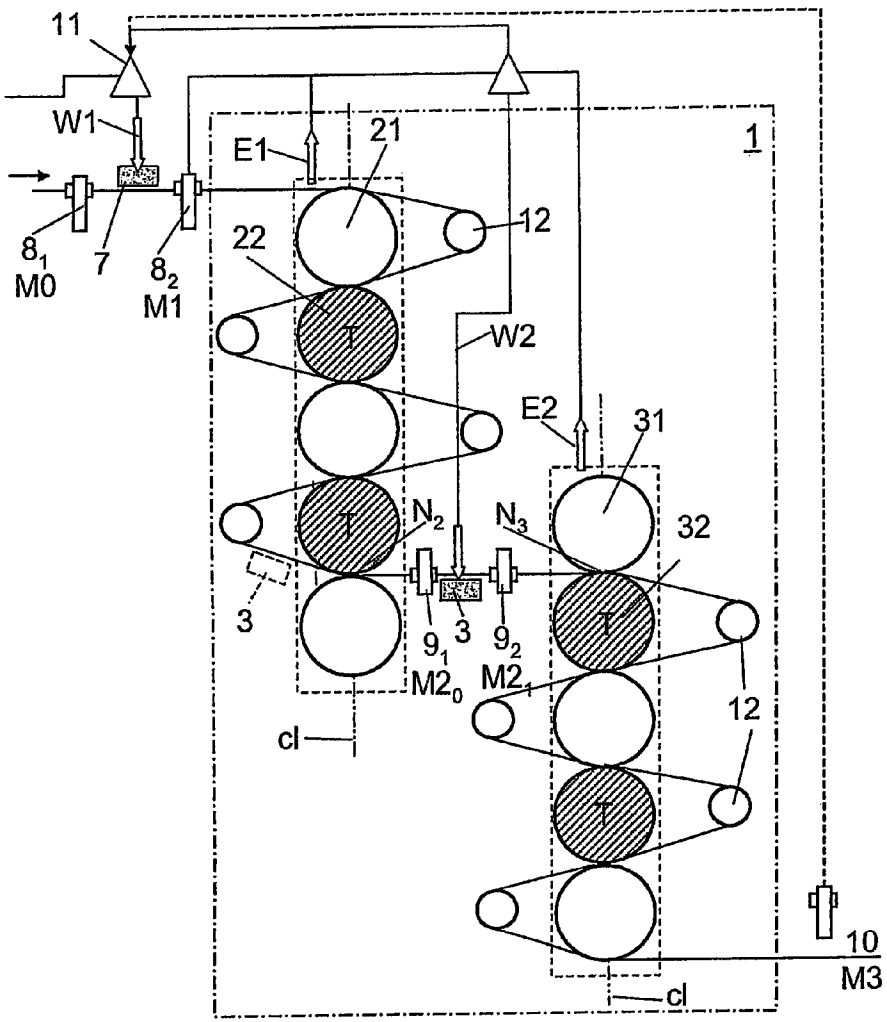

FIG. 4 is a schematic view of a fourth embodiment of the invention considered to be advantageous, showing 2-sided calendering by vertical stacks.

Figure 5:
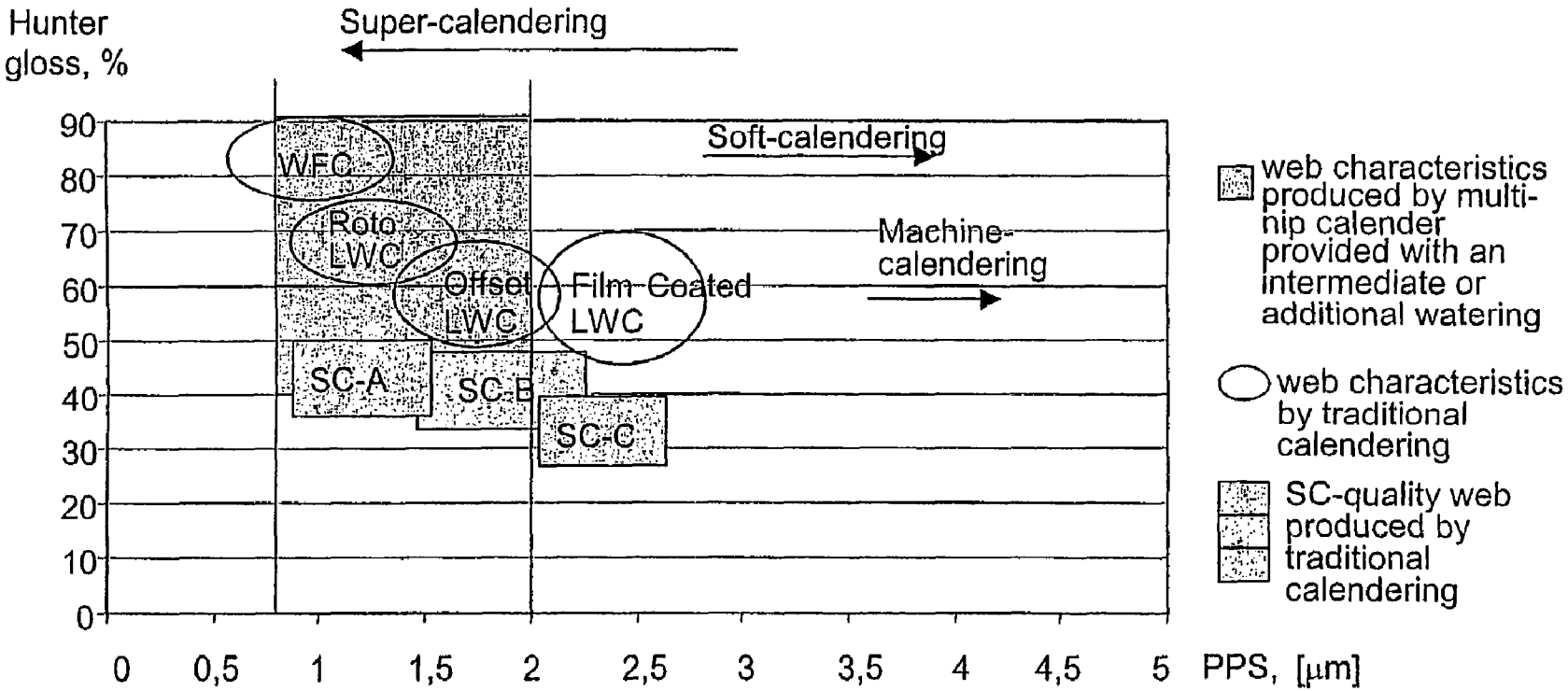

FIG. 5 illustrates paper grades obtained by different calendering techniques.

FIG. 6 shows a table that illustrates the change of the moisture contents of a web in a calender comprising two roll stacks.

DESCRIPTION OF THE PREFERRED EMBODIMENTS

It is generally stated in the beginning that the paper machine in itself is of no significance from the point of view of the basic principle of the invention or the operation of the invention, the paper machine being therefore illustrated, and only schematically in the figure, by the part preceding a calender 1. The part of the paper machine after the calender is not shown in the figures. It shall also be noted that the calender 1 in accordance with the invention can be an on-line or an off-line calender associated with the paper machine.

Figure 1:
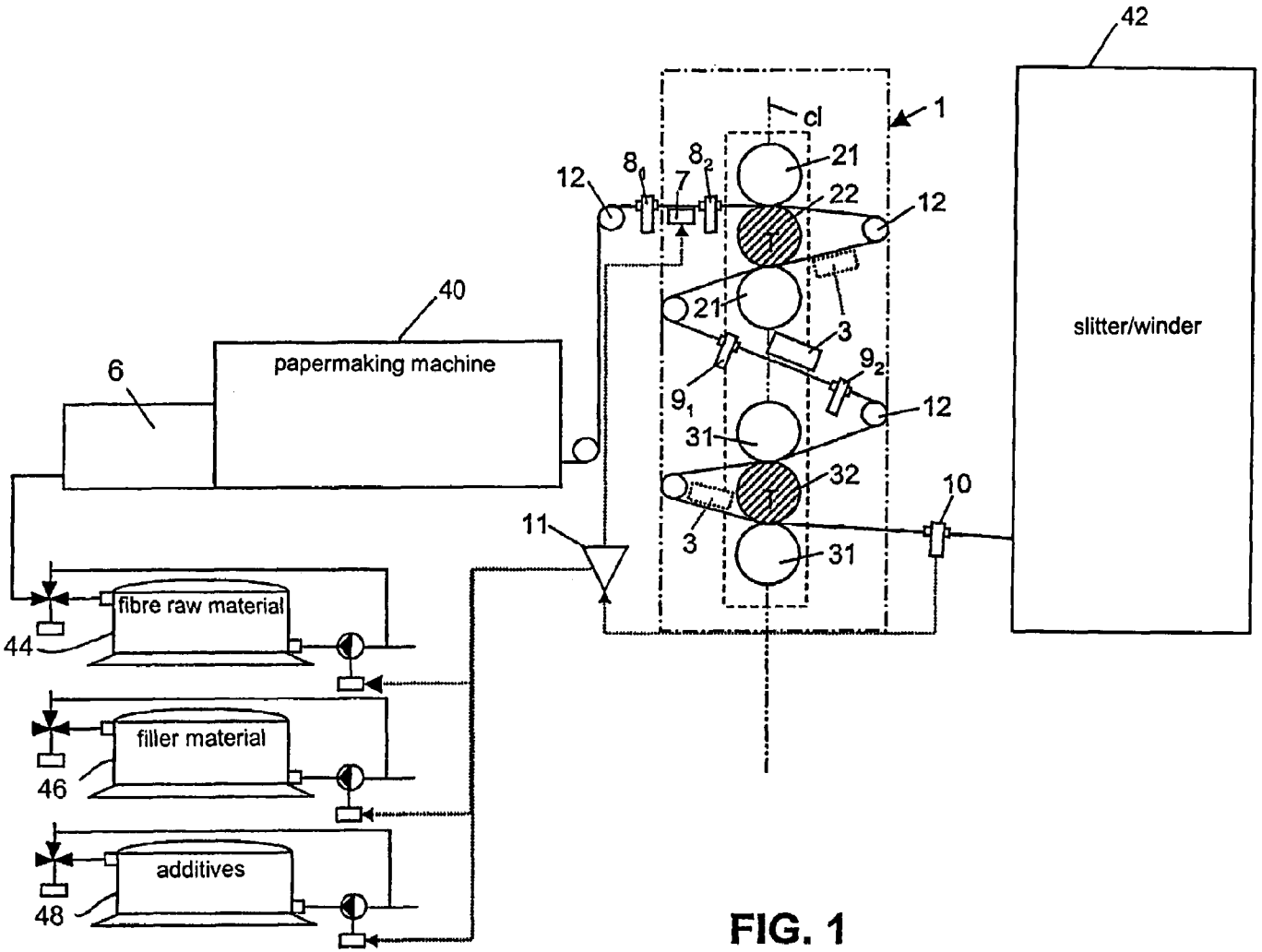
FIG. 1 is a schematic view of an embodiment of the invention considered to be advantageous.

In the first embodiment of the invention shown in FIG. 1, for controlling the moisture profile and/or moisture gradient of a paper web for the production of a high-quality and uncoated paper, in particular a paper of at least SC quality, in a paper machine comprising a calender 1 before a slitter-winder 42 of the web, the calender has two separate roll stacks, or a first roll stack 21, 22 and a second roll stack 31, 32, which are shown in FIG. 1 as substantially vertical and arranged such that the roll stacks have a common vertical center axis cl, which coincides with a nip line passing through nips that opposing rolls in roll pairs form between themselves.

In the embodiment of FIG. 1 there is a first or upper roll stack 21, 22 and a second or lower roll stack 31, 32, which are vertically separate from each other. The upper, or first, roll stack 21, 22 has three rolls, of which the middle roll is a thermo roll, i.e. a hard press roll 22, and of which the top and bottom rolls are soft-covered polymer or backing rolls 21. In the embodiment of FIG. 1, the lower, or second, roll stack 31, 32 also has three rolls, of which the top and bottom rolls are soft-covered polymer or backing rolls 31 and the middle roll of the lower roll stack remaining between them a thermo roll, i.e. a hard press roll 32.

With reference to FIGS. 1-4 it shall be emphasized that the number of rolls in the roll stacks 21, 22; 31, 32 is not of substantial significance for the operation of the invention, but the number of the rolls can be selected freely from the point of view of the invention. Thus, for forming a calender, different roll combinations $n_2+m_3$ of the roll stacks, in which $n_2$=the number of rolls in the first roll stack 21, 22 and $m_3$=the number of rolls in the second roll stack 31, 32, the numbers $n_2$ and $m_3$ being both an odd integer, may vary very widely, advantageously between 3 and 9 and can be even higher. However, in view of smooth transfer of the web it is advantageous that the number of the rolls is odd in the case of a calender in which a hard press roll 21, 31 and an elastic backing roll 22, 32 are placed alternately one after the other, as illustrated in FIGS. 1-4.

It shall be noted that the following are of more substantial significance from the viewpoint of the invention than the number of rolls:

- evaporations E1 and E2 of moistures occurring in the first roll stack 21, 22 in the second roll stack 31, 32, respectively, and
- in the calender, pre-moisturizing W1, intermediate moisturizing/moisturizings W2 of the web directed at the web, for example, between the rolls stacks 21, 22 and 31, 32, by means of intermediate moisturizers 3 in the cross direction transverse to the running direction of the web, because the moisture profile or the moisture gradient in the thickness direction, or z-direction, of the web can be controlled only by controlling moisturizings and evaporations and in particular by continuous regulation of the moisturizing of the web.

With reference to FIGS. 1-4 it is generally stated that in accordance with the general basic principle of the invention, the calender 1 is provided with a pre-moisturizer 7 which is situated before the calender and in which the web is moisturized to a desired pre-moisture content M1 substantially across its entire width in the width, or cross, direction transverse to the running direction of the web. In addition, the calender is provided with at least one intermediate or additional moisturizer 3, which is placed between a first calendering nip of the first roll stack of the calender and a first calendering nip of the last roll stack of the calender, particularly advantageously the intermediate or additional moisturizer is situated in the web portion between the first roll stack 21, 22 and the second roll stack 31, 32. The web is moisturized by means of the intermediate or additional moisturizer 3 in the cross direction substantially across its entire width from an intermediate moisture content $M2_0$ to which the moisture of the web has changed in the calender 1 or in a part of the calender preceding the intermediate or additional moisturizer, to a desired intermediate moisture content $M2_1$ before the last roll stack 31, 32, which dries the web to a desired final moisture value M3. The intermediate moisture value $M2_0$ can be measured by a moisture meter $\mathbf{9}_1$ and the intermediate moisture value $M2_1$ can be measured by a moisture meter $\mathbf{9}_2$. The number of the intermediate moisturizers can differ even considerably from the one moisturizer illustrated in FIGS. 1-4, depending, for example, on

- the desired z-direction moisture profile or moisture gradient of the intermediate moisturizing;
- the distance between the roll stacks 21, 22; 31, 32; and/or
- the length of the draw of the web between the roll stacks, which is naturally sought to be made as short as possible.

In FIG. 1, the order of the rolls and the run of the web around guide rolls 12 are such that only a first side of the web is calendered in the first roll stack 21, 22, which side is the lower side of the web placed against the thermo roll 22 at the entrance to the calender. In the second roll stack 31, 32 the other side of the web is calendered, which other side is the side opposite to the first side, said opposite side being placed against the thermo roll 32 at the entrance to the calender. It is thus a question of "2-sided calendering".

Reference is made to FIGS. $\mathbf{1}A_{1\text{-}6}$ and $\mathbf{1}B_{1\text{-}6}$, which illustrate different roll combinations with two roll stacks in accordance with the invention for constructing a calender in which the number of rolls is 3+5 and 5+3. FIGS. $1A_{1-6}$ and $1B_{1-6}$ show a first roll stack 21, 22 and a second roll stack 31, 32 in various placement alternatives. In addition, FIGS. $1A_1$ and $1B_1$ show reference numerals for a pre-moisturizer 7, an intermediate moisturizer 3 and a moisture meter 10. In FIGS. $1A_{2-6}$ and $1B_{2-6}$ the corresponding parts are shown without reference numerals. It is emphasized that the illustrated embodiments are not the only possible ones but numerous variations are feasible without being excluded from the scope of protection of the invention.

The second embodiment of the invention illustrated in FIG. 2 corresponds in essential parts thereof to the embodiment of FIG. 1. The clearest differences are that, in the embodiment of FIG. 2, the number of rolls both in an upper, or first, roll stack 21, 22 and in a lower, or second, roll stack 31, 32 is higher, being five, that the distance between the roll stacks is clearly shorter in the embodiment of FIG. 2, which can be accomplished, for example, by different loading of the loading arms of rolls of a normal supercalender. In respect of the roll stacks, there is no substantial difference between the first and the second embodiment of the invention shown in FIGS. 1 and 2 because the nip lines of the roll stacks 21, 22; 31, 32 coincide with the center line cl of the roll stacks. In connection with the center line, a difference between the first and the second embodiment shown in FIGS. 1 and 2 is, however, that in the embodiment of FIG. 1 the center line cl is vertical with respect to the horizontal machine plane and in the embodiment of FIG. 2 the center line cl is at an oblique angle to the vertical plane with respect to the horizontal machine plane. By disposing the center line cl so that it is oblique with respect to the vertical plane, it is possible, on the one hand, to reduce the load which is caused by the mass of the rolls because of gravity and which acts on the roll stack and, on the other hand, the entire roll stack 21, 22; 31, 32 can be disposed in a lower hall space, thereby enabling considerable savings in the building costs of the hall. It shall be noted that said oblique angle can also be selected so that it is substantially a right angle, whereby it is possible to totally avoid the load which is caused by the mass of the rolls because of gravity and which acts on the roll stack while, at the same time, the calender can be accommodated in a hall whose height substantially corresponds only to the length of the shaft of the rolls in the calender. Since in this embodiment of FIG. 2, the web is also passed such that a first side of the web is calendered in the first roll stack 21, 22 of the calender and a second side of the web is calendered in the second roll stack 31, 32, it is thus a question of "2-sided calendering".

In the third embodiment of the invention shown in FIG. 3, the calender comprises a first roll stack 21, 22 having three rolls and a second roll stack 31, 32 having five rolls, said roll stacks being horizontally separate from each other. The calender of FIG. 3 differs from the calenders of FIGS. 1 and 2 most substantially in that both roll stacks of the calender 1 are in a vertical position with respect to the horizontal machine plane.

In the calender 1 of FIG. 3, the order of the rolls and the run of the web are such that a first side of the web is calendered in the first roll stack 21, 22 and a second side of the web is calendered in the second roll stack 31, 32, which second side is the side opposite to the first side. Thus, the embodiment of FIG. 3 also concerns "2-sided calendering".

FIG. 4 shows an embodiment in accordance with the invention in which a first roll stack 21, 22 and a second roll stack 31, 32 of a calender with two roll stacks are placed such that the last calendering nip $N_2$ of the first roll stack 21, 22 is on the same horizontal plane as the first calendering nip $N_3$ of the second roll stack 31, 32. With this placement the location of guide rolls 12 of the roll stacks 21, 22 and 31, 32 does not impose any limitation on the distance required by the roll stacks 21, 22 and 31, 32. An advantage of this embodiment is the minimization of the distance between the nips $N_2$ and $N_3$, thereby allowing the roll stacks 21, 22; 31, 32 to be placed as close to each other as possible in the machine direction. The distance between the nips $N_2$ and $N_3$ is limited only by the placement of an intermediate moisturizer 3 in the web portion between the roll stacks 21, 22; 31, 32. If the intermediate moisturizer 3 is placed in the web portion within one of the rolls stacks 21, 22; 31, 32 (shown with a broken line in FIG. 4), the distance between the nips $N_2$ and $N_3$ can be made as short as possible.

Since moisturizing of an already calendered web surface is not advantageous for achieving the best possible calendering result, in the multi-nip calender 1 the intermediate or additional moisturizer 3 does not moisturize that surface of the web which has been calendered in the preceding calender or in a part of the calender 1. Thus, the intermediate or additional moisturizer 3 moisturizes that surface of the web which is calendered in the second roll stack 31, 32 situated after the intermediate or additional moisturizer 3. Water or steam or another liquid medium and, advantageously, for example, nozzle or lip moisturizing are used for moisturizing.

If the web is passed from the first roll stack 21, 22 directly (cf. FIG. 3) or only via one guide roll 12 (cf. FIGS. 1 and 2) between a soft-covered roll 31 and a thermo roll 32 of the second roll stack 31, 32 and after that via guide rolls upwards, as in FIG. 3, or downwards, as in FIGS. 1 and 2, only one and the same side of the web is calendered. In that case, a matte-quality web is obtained as a result of calendering. A difference with respect to two-sided calendering is that the necessary intermediate or additional moisturizing W2 by means of the intermediate or additional moisturizer 3 as well as the pre-moisturizing W1 by means of the pre-moisturizer 7 are applied to the web surface to the calendered.

To accomplish the basic principle of the invention, i.e. to continuously control and optimize the thickness-direction, or z-direction, moisture profile and/or moisture gradient of the web in the calender 1, the pre-moisturizing W1 of the web is controlled by means of the pre-moisturizer 7 situated before the calender 1 by raising the moisture content of the web from the initial moisture content M0 before the pre-moisturizer to the desired pre-moisture content M1 before the calender 1 automatically, in which connection the calculated or measured final moisture value M3 of the web can be passed, for example, by means of a feedback connection, to serve as a control parameter of the pre-moisturizer 7. In accordance with the invention, the control of the pre-moisturizer 7 can also be manual for raising the initial moisture content M0 of the web before the pre-moisturizer 7 to the desired pre-moisture content M1 before the calender 1. The initial moisture value M0 can be measured by a moisture meter $8_1$ and the pre-moisture value M1 can be measured by a moisture meter $8_2$.

In accordance with the invention, as also illustrated in FIGS. 1-4, the final moisture value M3 of the web to be passed to the pre-moisturizer 7 can be provided either by measuring the final moisture value by means of a moisture meter 10 placed after the calender 1 or by calculating the final moisture value M3 corresponding to the final moisture content of the web. In both embodiments, the final moisture value M3 can be passed by means of a coupling means 11 to serve as a control parameter of the pre-moisturizer 7. By the coupling means 11 it is also possible to select which of the two embodiments is applied for passing the final moisture value M3 to form a control parameter of the pre-moisturizer 7.

FIG. 1 illustrates one further possibility enabled by the coupling means 11—the final moisture value M3 of the web measured or calculated by means of the coupling means 11 can be passed so as to control the feed of additives, fillers and fibre raw materials needed in the manufacture of paper into the headbox of the paper machine, thus not only homogenizing the pulp and layer distribution of the web being formed but also controlling the moisture profile and moisture gradient of the web over the entire length of the paper machine. A controlled flow of additives from an additives tank 48 into a headbox 6 of a paper machine 40, and a controlled flow of a filler from a fillers tank 46 into the headbox 6 of the paper machine 40, and a controlled flow of fibre raw material from a fibre raw material chest 44 into the headbox 6 of the paper machine 40 is particularly advantageous when a multi-layer web is produced on the paper machine.

Reference is made to FIG. 3, in which the final moisture value M3 of the web after the calender 1, said final moisture value being passed to form a control parameter of the pre-moisturizer 7, has been calculated from the values:

- pre-moisture value M1 of the web, which is the moisture value of the web after the pre-moisturizing W1 of the web before the first roll stack 21, 22 of the calender 1;
- evaporations E1 and E2 of moisture that have occurred in the roll stacks 21, 22 and 31, 32; and
- intermediate moisturizings W2 of the web carried out by each intermediate moisturizer 3 of the web.

The final moisture content M3 can thus be calculated from the formula M3=M1+E1+W2+E2.

In the embodiment of FIG. 3, the evaporation E1 of the first roll stack 21, 22 and the evaporation E2 of the second roll stack 31, 32 and the intermediate or additional moisturizing W2 of the web have been summed to form a first subtotal, which equals to the total evaporation ΣEn of moisture from the web in the calender 1. Finally, this subtotal coupled together with the pre-moisture content M1 of the web has been passed to the coupling means 11, from which the calculated final moisture value of the web has been passed to form a control parameter of the moisturizer 7 to raise the initial moisture content M0 of the web to the desired pre-moisture content M1 before the calender 1.

Alternatively, as illustrated in FIGS. 1, 2 and 3, instead of a calculated control parameter of the pre-moisturizer 7, a measured final moisture value of the web can be passed to serve as a control parameter of the pre-moisturizer.

Further, it may be generally stated in connection with the invention that the control of the pre-moisturizing W1 of the web can be accomplished manually or it can be automated and that after ascertaining available measurement values and other necessary quantities, the automation of control does not in itself pose any longer a problem to a person skilled in automation and/or control technology, wherefore this is not described in any more detail.

The measured or calculated final moisture content of the web can also be passed, when needed, to form a control parameter of the headbox 6 of the paper machine 40 and, in that case, particularly advantageously for optimizing the ratios and quantities of fibre raw material, filler material and additives.

In accordance with one embodiment of the invention considered to be advantageous, in order to determine the final moisture content M3 of the web and thus to calculate the control parameter of the pre-moisturizer 7 of the web in the coupling means 11, it is possible to use in the coupling means 11 the formula $$M3=M1+100\%\ (E1+W2+E2)/\text{square meter of web},$$

in which formula

- M1[%]=pre-moisture content of the web before the calender,
- E1[g/m$^2$]=evaporation of moisture per square meter of web in the calender roll stack 21, 22,
- E2[g/m$^2$]=evaporation of moisture per square meter of web in the calender roll stack 31, 32,
- W2[g/m$^2$]=intermediate or additional moisturizing of the web per square meter of web.

Depending on the need to calculate subtotals,

- total roll stack evaporation per square meter of web can be calculated with the formula ΣE=100%(E1+E2+ . . . +En)/square meter of web, where En is roll stack evaporation in a single roll stack (21, 22; 31, 32), and
- a subtotal taking account of the intermediate or additional moisturizing and the total roll stack moisturizing can be calculated with the formula 100% (W2+ΣE)/square meter of web.

As stated above, the final moisture value of a multi-layer web in particular can be generally calculated, in accordance with the invention, with the formula $$M3=M1+W+E,$$

where

- M1=moisture content of a multi-layer web (typically about 5%) before calendering,
- W=total moisturizing during calendering=W2n, where
- W2 is intermediate moisturizing of the web
- n is the number of intermediate or additional moisturizings, and
- ΣEn=total evaporation during calendering=En,
- where En is total roll stack evaporation in a single roll stack, so that M3=M1+x·W−E=the moisture content of the multi-layer web (typically about 3%) after calendering, in which formula x=0.5-1.0, when the multi-layer web is overdry, i.e. M1<M3; x=0.3-0.7, when M1=M3; and x=0-0.5, when M1>M3.

Reference is made to FIG. 5, which illustrates paper grades that can be obtained by different calendering techniques. It may be seen that by multi-nip calendering of an uncoated web it is possible to produce different SC-quality printing paper grades, of which SC-C, SC-B, SC-A, SC-A+, SC-A++ and more demanding wood-containing printing papers can be mentioned as examples. As FIG. 5 shows, the method, the system and the calender in accordance with the invention make it possible to produce a web whose range of roughness/Hunter gloss is above today's SC qualities and covers even the range of roughness/Hunter gloss of today's LWC qualities.

In particular, concerning the quality of the web obtained by the method, system or calender in accordance with the invention it may be stated that, when the range of roughness of the web is between 0.8 and 2.0 μm, the average Hunter gloss of the web as an average of the upper-lower surfaces is at least 45%, advantageously >50% even >53%. By means of more precise moisture control, in the same range of roughness of the web, i.e. 0.8-2.0 μm, the Hunter gloss as an average of the upper-lower surfaces is at least 55%, advantageously 58% even >60%. In that case, the web has been processed by the method, system or calender in accordance with the invention from a pulp that contains mechanical pulp and/or chemical pulp whose basis weight is 30-80 g/m$^2$.

EXAMPLE

Reference is made to the Table shown in FIG. 6 illustrating the change of moisture contents of the web in a calender provided with a pre-moisturizer 7 and an intermediate or additional moisturizer 3 in accordance with the invention and comprising two separate roll stacks. In this example, the roll stacks 21, 22; 31, 32 have been positioned, as in FIG. 3, so that they are horizontally apart from each other and the intermediate or additional moisturizer 3 is situated between the roll stacks.

Above, the invention has been described only by way of example by means of one of its embodiments regarded as advantageous. This is, of course, not meant to limit the invention and, as is clear to a person skilled in the art, various alternative arrangements and variations are feasible within the inventive idea and its scope of protection defined in the appended claims.

Thus, the following is stated regarding the rolls and the roll stacks formed by them. The mutual orientation of individual rolls with respect to one another in the roll stack is free, which means that the line passing through the centers of the rolls can be straight, so that the center line cl of the roll stack can be a vertical line in accordance with the embodiments of FIGS. 1, 2 and 4 or an oblique line with respect to the vertical line in accordance with the embodiments of FIGS. 1A, 1B and 2 or even a horizontal center line. The line passing through the centers of the rolls can also form an angle or angles, i.e. a broken line. The orientation of the rolls stacks with respect to each other is also free, so that the longitudinal center lines of imagined parallelepiped-shaped border lines drawn around the roll stacks can be parallel to one another and, at the same time, on the same machine direction line of the paper machine, or divergent and on different machine direction lines of the paper machine. The orientation of the center lines of the roll stacks can also be vertical, oblique or even horizontal with respect to the horizontal machine plane. In addition, two such center lines can form between themselves an angle that is acute or obtuse. Also, a plane surface passing through the nip lines in one roll stack can be in a rotated orientation with respect to a plane surface passing through the nips of the other roll stack.

A roll stack equivalent to two or more structurally separate roll stacks is achieved in a calender in which some of the rolls can be moved, as a group or groups with respect to the groups formed by other rolls, out of nip-forming contact. An advantageous separation line passes in that case at a reversing nip, the intermediate moisturizing of the web being arranged in the adjacency of this separation point of nip groups. A benefit of this kind of calender is that the calender can be used for full-nip operation as a normal multi-roll calender, which is provided with intermediate moisturizing of the web and advantageously also with roll stack moisturizing of the web, or for partial-nip operation, in which connection some of the roll pairs have been separated so that they are no longer in contact with each other, i.e. in a nip-forming contact, and the web is calendered in a selectable number of nips, depending on the desired quality.

The invention claimed is:

1. A method for controlling the moisture gradient in production of an uncoated paper web of at least SC quality, having a cross direction, a running direction and a thickness direction, comprising the steps of:

pre-moisturizing, with a pre-moisturizer, the paper web in the cross direction substantially across the entire width of the web from an initial moisture content before pre-moisturizing to a selected pre-moisture content;

passing the pre-moisturized paper web through a multi-nip calender having at least a first roll stack and a last roll stack, each roll stack having at least three rolls, and wherein the multi-nip calender is situated before a slitter-winder of the web;

intermediate-moisturizing the web, with an intermediate-moisturizer, in the cross direction substantially across the entire width of the web before the last roll stack and after a first calendering nip of the first roll stack to a selected intermediate moisture content;

drying the web in the last roll stack to a selected final moisture value;

continuously controlling the moisture gradient of the web in the thickness-direction in the multi-nip calender by adjusting the pre-moisturizing of the web, based on a calculated or measured value of the selected final moisture value of the web.

2. The method of claim 1, wherein the pre-moisturizer is controlled by the final moisture value of the web as measured after the last roll stack.

3. The method of claim 1 wherein the intermediate moisturizer is controlled by the final moisture value of the web as measured after the last roll stack.

4. The method of claim 1 wherein the pre-moisturizer or the intermediate moisturizer is controlled automatically.

5. The method of claim 1 wherein a final moisture value is calculated from the selected pre-moisture value of the web and from evaporation of moisture that has occurred in each roll stack; and the intermediate moisturizing of the web is carried out by the intermediate moisturizer of the web.

6. The method of claim 1 wherein evaporations from each roll and the additional or intermediate moisturizing of the web form a subtotal, and that said subtotal and the pre-moisture value of the web are passed as separate variables through a coupling means to serve as a control parameter of the pre-moisturizer.

7. The method of claim 1 wherein the final moisture value which has been either measured, or calculated in a coupling means, is passed by means of the coupling means to serve as a control parameter of the pre-moisturizer.

* * * * *